United States Patent [19]

Ward

[11] Patent Number: 4,974,280

[45] Date of Patent: Dec. 4, 1990

[54] SNAKE DIRECTING TOOL

[76] Inventor: Josiah P. Ward, 4275 N. 3rd Ave., San Bernadino, Calif. 92407

[21] Appl. No.: 380,549

[22] Filed: Jul. 17, 1989

[51] Int. Cl.[5] ..... A47G 29/00; B08B 9/04; B08B 9/02

[52] U.S. Cl. ..... 15/257 R; 15/104.33; 15/104.31; 254/134.3 FT

[58] Field of Search ..... 15/257, 104.33, 104.32; 254/134.3 PT; 52/65, 114, 169.14; 414/22.51, 22.61

[56] References Cited

U.S. PATENT DOCUMENTS

| | | | |
|---|---|---|---|
| 1,821,949 | 9/1931 | Selah . | |
| 1,824,924 | 9/1931 | Paul et al. | 15/104.33 |
| 1,982,402 | 11/1934 | Shade . | |
| 2,005,936 | 6/1935 | Crane | 15/104.33 |
| 2,163,947 | 6/1939 | Hochberger | 15/104.33 |
| 2,911,235 | 11/1959 | Stumbough | 285/93 |
| 2,946,560 | 7/1960 | Ferm | 254/134.3 FT |
| 4,391,551 | 7/1983 | Belcher | 403/43 |

*Primary Examiner*—Harvey G. Hornsby
*Assistant Examiner*—Gary K. Graham
*Attorney, Agent, or Firm*—Harvey S. Hertz

[57] ABSTRACT

A snake directing tool for directing a sewer line clean-out snake in either direction of the sewer line connecting a building to the main sewer line. A two way clean-out, accessible by means of a vertical pipe connected to a pair of Y-arms, having a baffle form therein connects the vertical pipe to either a main sewer line outlet or a building sewer line interconnected by a horizontal pipe. The tool is insertable into the vertical pipe and abutable onto a baffle. The tool includes a side wall for directing the snake toward the building sewer line or the main sewer line outlet.

3 Claims, 1 Drawing Sheet

FIG. 1
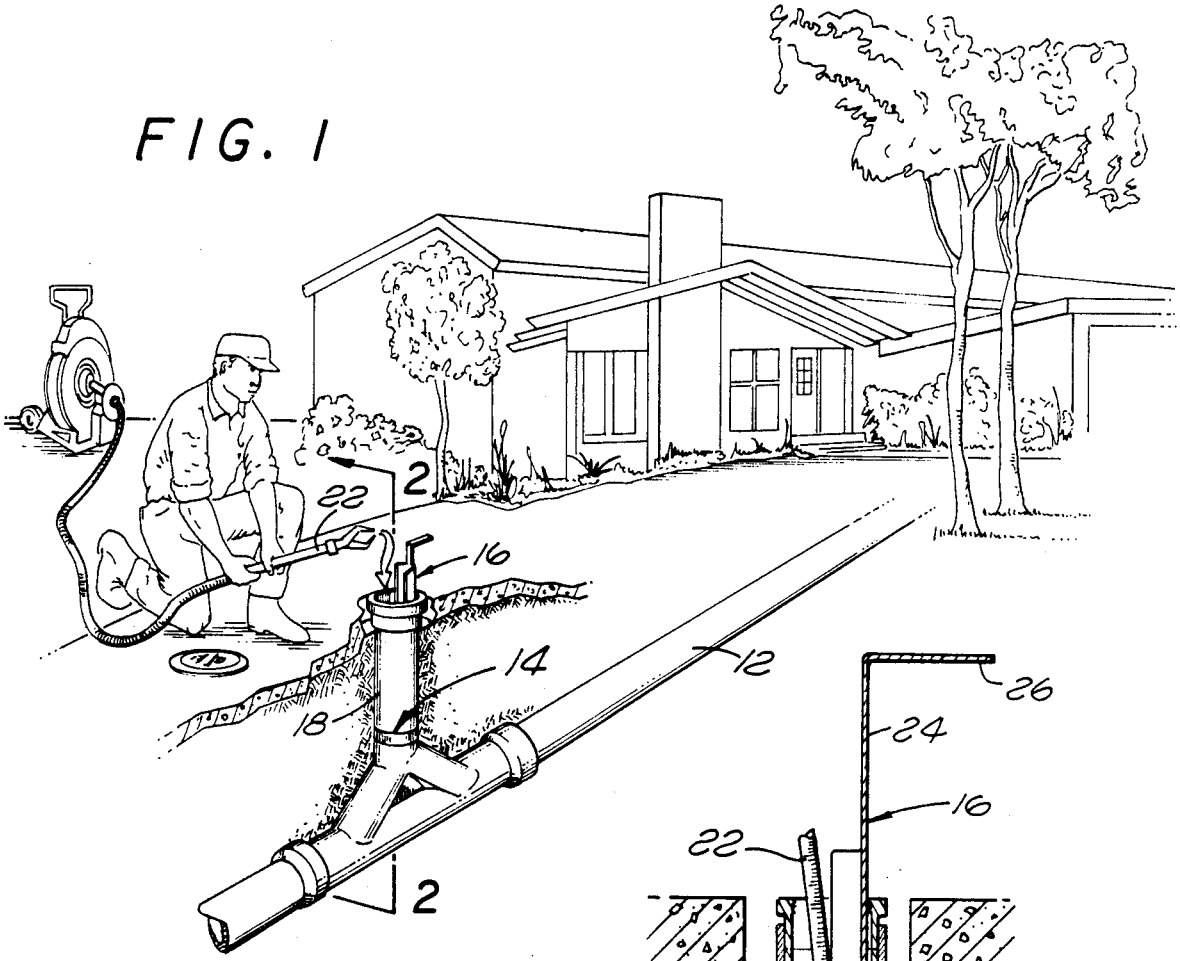
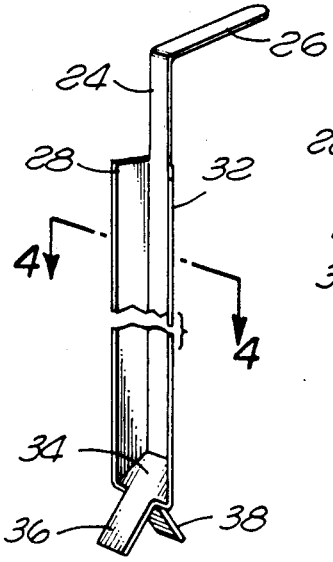
FIG. 3
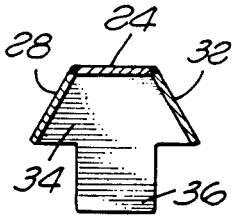
FIG. 4
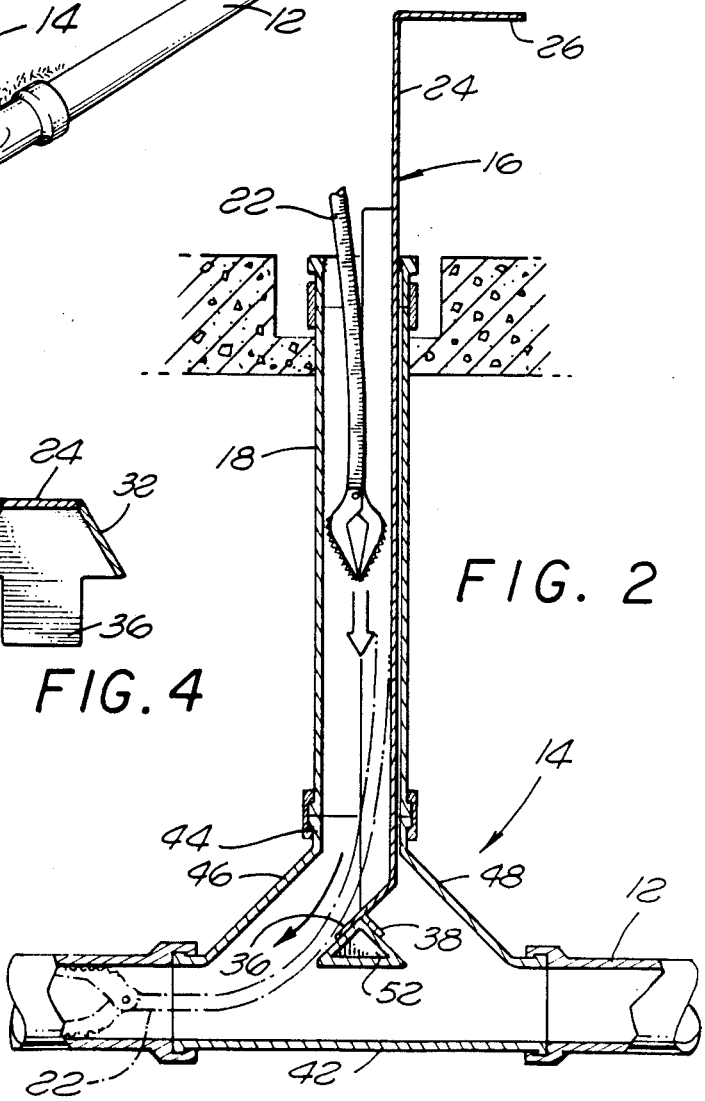
FIG. 2

SNAKE DIRECTING TOOL

BACKGROUND OF THE INVENTION

1. Field of the Invention

The field of art to which the invention pertains includes the field of sewer line cleanouts, and more particularly, to a snake directing tool for directing a sewer line snake in the direction of a building or the main sewer line.

2. Description of the Prior Art

When utilizing a snake for cleaning out the sewer line interconnecting a building and the main sewer line which normally passes in the steet, it is necessary to insert the snake into the sewer line interconnecting the building and the main sewer line. Access to such a sewer line is by means of a two-way clean out or a "Pomona Fitting". A removable cap normally covers access to the two way cleanout. When the cap is removed, the snake is inserted therein. However, it is difficult to determine whether the snake is directed toward the building or the main sewer line. In most cases, it is unknown where a blockage in the sewer line has occurred and, therefore, it is necessary to direct the snake toward both the building and toward the main sewer line. Where the sewer line is adjacent to ground level, removal of the access cover to the two-way cleanout enables the plumber or other person using the snake to view which way the snake is being directed. However, when the sewer line is buried a substantial distance below ground, the two-way cleanout is normally connected by means of an extension pipe so that the cover is above ground and easily accessible. Therefore, when the snake is inserted into the extension it is difficult to determine in which the direction the snake is proceeding. Prior art snake directing devices are well known.

Other known prior art includes U.S. Pat. Nos. 4,391,551; 1,821,949; 2,911,235; and 1,982,402.

The present invention provides a snake directing tool for insertion in a two-way cleanout, primarily in cases where it is difficult to view the direction in which the snake is proceeding. The tool is inserted into the two-way cleanout and by positioning of the tool, the snake can be directed toward the main sewer line in the street or the building.

SUMMARY OF THE INVENTION

A snake directing tool for directing a sewer line cleanout snake in either direction of a sewer line connecting a building to the main sewer line having a two-way cleanout accessible by means of a vertical pipe connected to Y-arms. The Y-arms have a baffle form therein for connecting the vertical pipe to either a main sewer line outlet or a building line interconnected by a horizontal pipe main outlet. The tool is insertable into the vertical pipe and abuts onto a baffle. A side wall is formed on the tool for directing the snake toward the building or toward the main sewer line.

The advantages of this invention both as to its construction and mode of operation, will be readily appreciated as the same becomes better understood by reference to the following detailed description when considered in connection with the accompanying drawings in which like reference numerals indicate like parts throughout the figures.

BRIEF DESCRIPTION OF THE DRAWINGS

FIG. 1 is a perspective view of a two-way cleanout installed on a sewer line;

FIG. 2 is cross-sectional view of the two-way clean out having the snake directing tool inserted therein;

FIG. 3 is a perspective view of the snake directing tool.

FIG. 4 is a cross-sectional view of the snake directing tool taken along the line 4—4 thereof.

DESCRIPTION OF THE PREFERRED EMBODIMENT

Referring now to the drawings, there is shown in FIG. 1 a sewer line outlet 12 which is used to connect the sewer lines of a home to the main sewer line usually found in a street. Normally the sewer lines have a two-way outlet 14 connected thereto. Such a sewer two way cleanout is commonly referred to as a "Pomona fitting". Easy access to the sewer line outlet is provided by the two way clean out 14 enabeling a plumber to clean the sewer line outlet should blockage occur. Typically, the blockage will occur between the two way clean out 14 and the building or between the two way clean out and the main sewer line in the street. Thus, it is normally necessary to run a snake towards both the building and the main sewer line in the street.

The purpose of this invention is to enable the user of the snake to know that the snake has been directed in both directions as it is normally visually impossible to determine which direction the snake is traveling.

As illustrated in FIG. 2 the snake directing tool 16 is inserted into the two way clean out 14 via an opening in a vertical extension pipe 18 whose cover (not shown) has been removed. The snake 22 in the case of FIG. 2 is directed to the left in the drawing. Positioning the snake directing tool 16 in a second position enables the snake 22 to be directed toward the right in the sewer line outlet 12 in the drawing.

The snake directing tool 16 is shown in greater detail in FIG. 3 and comprises a generally vertical arm 24 having a horizontal arm or handle 26 connected to the upper end thereof. The lower end of the vertical arm 24 contains a pair of side walls 28 and 32 which together define a generally U -shaped directing surface for the snake 22.(See FIG. 4) The lower end of the vertical arm 24 contains a generally angled surface 34 which together with the sidewalls 28 and 32 form the bottom part of the snake directing tool 16. A pair of inverted V-mating legs 36 and 38 are connected to the bottom of the snake directing tool 16 with the leg 36 forming an extension of the angeled surface 34.

Referring once again to FIG. 2, the two-way cleanout 14 comprises a horizontal pipe 42 which is a continuation of the sewer line outlet 12 and is coupled thereto. The cleanout 14 further comprises a stub 44 to which the vertical extension pipe 18 is coupled and a pair of Y-shaped arms 46 and 48 which are integral with the vertical stub 44 and the horizontal pipe 42 and form an interconnection therewith. A baffle 52 of triangular shape is formed at the junction of the Y-shaped arms 46 and 48.

When the snake directing tool 16 is inserted into the two-way cleanout 14 in the manner shown in FIG. 2, the inverted V-mating legs 36 and 38 will abut the baffle 52. When the snake 22 is then inserted into the extension pipe 18, the side walls 28 and 32 will direct the snake 22 in the direction to the left shown in FIG. 2. When the snake directing tool 16 is raised slightly so that it can be rotated 180 degrees and then again positioned adjacent the baffle 52, the snake will be directed in the direction in the right in FIG. 2.

Thus, the user of the snake 22 can position the snake directing tool 16 in two directions and know that the snake 22 is being directed toward the building and toward the main sewer line and that any blockage in either of these lines will be cleaned out by the snake.

I claim:

1. A snake directing tool for directing a sewer line cleanout snake to either direction of a sewer line connecting a building to a main sewer line having a two-way cleanout accessible by means of a vertical pipe connected to Y-arms, said Y-arms having a baffle formed therein for connecting said vertical pipe to either a main sewer line outlet or a building interconnected by a horizontal pipe outlet, the invention comprising:

a tool insertable into said vertical pipe and abutable onto said baffle, and side wall means formed on said tool for directing said snake toward said building or said main sewer line, said tool containing a pair of V-shaped mating legs connected to one end of said tool and adapted to be positioned on said baffle for locking said tool thereon.

2. A snake directing tool in accordance with claim 1 wherein said tool comprises a vertical arm extending along the axis of said vertical pipe when inserted therein, said side wall means forming extensions of said vertical arm to define a generally U-shaped cross-sectional shape perpendicular to the axis of said vertical arm and said sidewalls.

3. A snake directing tool in accordance with claim 2 wherein said tool containes a horizontal arm connected to an end of said vertical arm.

* * * * *